US005187312A

United States Patent [19]

Osborne

[11] Patent Number: 5,187,312

[45] Date of Patent: Feb. 16, 1993

[54] TWO STAGE TRIGGER ASSEMBLY

[75] Inventor: William E. Osborne, Guilford, Conn.

[73] Assignee: The Marlin Firearms Company, North Haven, Conn.

[21] Appl. No.: 777,021

[22] Filed: Oct. 16, 1991

[51] Int. Cl.[5] ..... F41A 19/16

[52] U.S. Cl. ..... 42/69.01; 42/69.02

[58] Field of Search ..... 42/69.01, 69.02, 69.03, 42/41, 42.01, 65

[56] References Cited

U.S. PATENT DOCUMENTS 4,005,540 2/1977 Robinson ..... 42/69.01

4,662,098 5/1987 Timari ..... 42/69.01

FOREIGN PATENT DOCUMENTS 955075 1/1950 France ..... 42/69.02

*Primary Examiner*—Michael J. Carone

*Attorney, Agent, or Firm*—Chilton, Alix & Van Kirk

[57] ABSTRACT

A two stage trigger assembly for a firearm employs a pivotally mounted searprop. The searprop is selectively pivotally coupled with the trigger. Upon actuation of the trigger, the searprop initially in a first stage remains fixed relative to the sear. In a second stage, the trigger catches the searprop to pivotally force the searprop to release from the sear to fire the firearm.

21 Claims, 5 Drawing Sheets

TWO STAGE TRIGGER ASSEMBLY

BACKGROUND OF THE INVENTION

This invention relates generally to trigger assemblies such as employed in sporting firearms. More particularly, the present invention relates to trigger assemblies which have a two stage trigger actuated firing sequence.

In firearms to which the invention relates such as, for example, disclosed in U.S. Pat. No. 4,897,951 of the assignee of the present invention, the trigger assembly is positioned at the underside of a receiver which receives a retractable bolt assembly. The bolt assembly includes a spring loaded firing pin which is released through a sear by means of manual actuation of the trigger. The sear and the trigger are positioned and pivotally mounted to the studs in a slot defined between a pair of downwardly extending studs. Pivotal movement of the trigger releases the sear for pivoting in the same direction to fire the firearm. A safety engageable with the trigger is provided to prevent accidental firing of the firearm.

For certain types of target shooting, particularly in connection with athletic competition involving strenuous activity, a two stage trigger actuation is often desirable. The two stage trigger actuation allows the shooter to have a more comfortable feel for the trigger prior to actual firing of the firearm. For certain competitors, the two stage actuation enhances the rapid deployment of the firearm and provides a more accurate firearm aim.

SUMMARY OF THE INVENTION

Briefly stated, the invention in a preferred form is a new and improved trigger assembly which implements a two stage trigger actuation for firing a firearm. The trigger assembly comprises a trigger which is pivotally mounted at the underside of the firearm receiver. A searprop is also pivotally mounted with the trigger mounting components. The sear is engageable with the searprop. The searprop has an aperture which has a pre-established diameter. A pin is fixedly mounted to the trigger and transversely extends from the trigger through the aperture of the searprop. The pin has a diameter which is less than the pre-established diameter of the searprop aperture. A spring assembly engages the trigger and biases the trigger to the forward position.

As the trigger is pulled rearwardly to fire the firearm, in a first stage the pin moves from a first forward position relative to the searprop aperture toward a second position relative to the aperture. During the first stage, the pin moves unimpeded from one side of the aperture to the opposing side and does not effectively engage the searprop in a manner which causes pivotal movement of the searprop. During the second stage, the pin engages the searprop to initially commence pivoting of the searprop for ultimate disengagement, from the sear. Upon disengagement, the sear is allowed to pivot to thereby release the firing pin and fire the firearm.

In a preferred embodiment, the trigger has a forwardly disposed bifurcated portion which defines a central slot for receiving the searprop. The pin extends between the opposed spaced portions of the trigger. The sear may have a notch which facilitates the engagement of the searprop with the sear during the pre-fire cocked position.

An object of the invention is to provide a new and improved two stage trigger actuation for a firearm.

Another object of the invention is to provide a new and improved trigger assembly which implements a two stage trigger actuation in an efficient and reliable manner.

A further object of the invention is to provide a new and improved trigger assembly having a relatively inexpensive construction and which implements a well-defined two stage trigger actuation.

Other objects and advantages of the invention will become apparent from the drawings and the specification.

DETAILED DESCRIPTION OF THE PREFERRED EMBODIMENT

Figure 1:
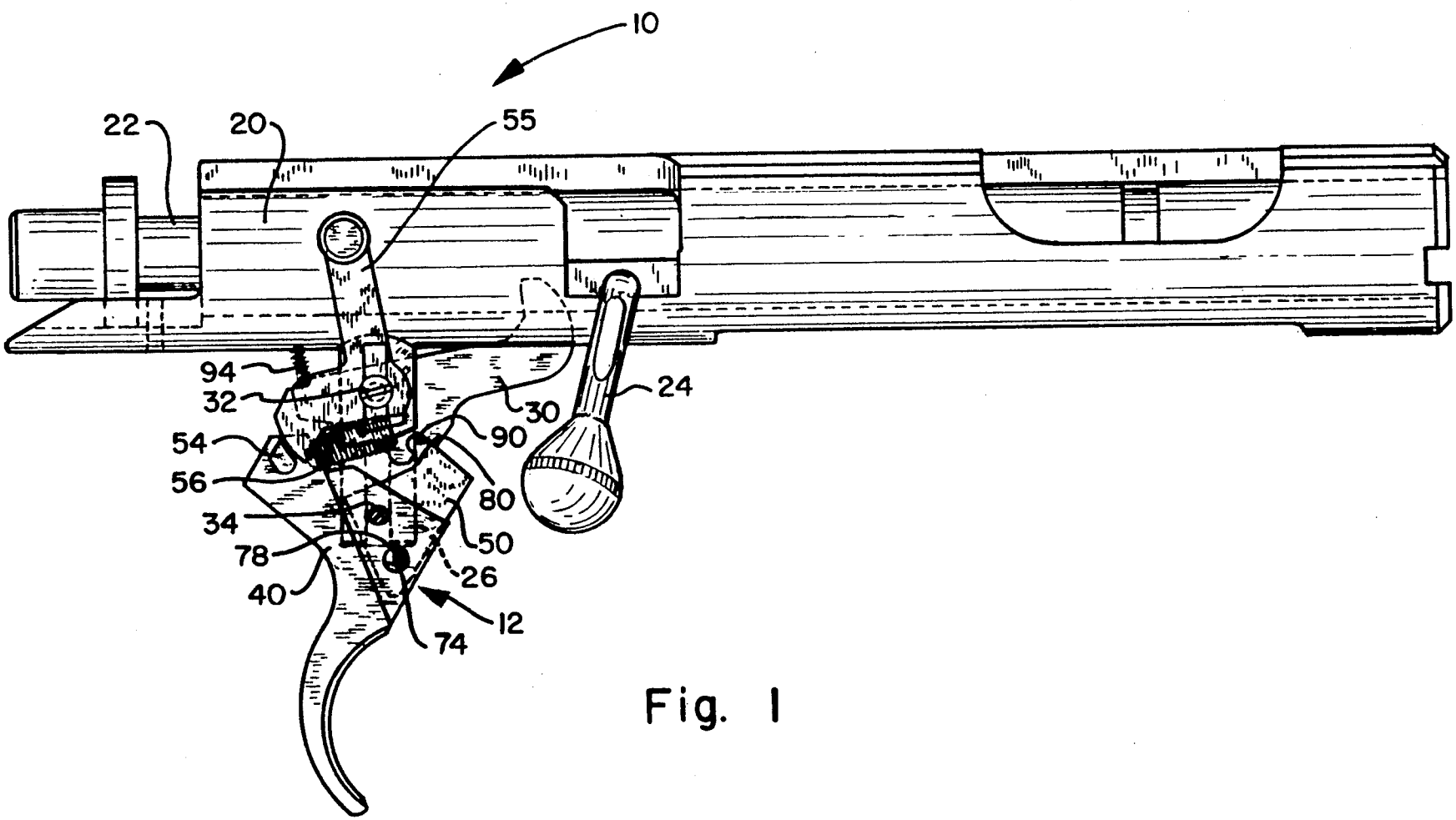
FIG. 1 is a fragmentary side view, partly broken away and partly in phantom, of a firearm incorporating a two stage trigger assembly in accordance with the present invention.

With reference to the drawings wherein like numerals represent like parts throughout the several figures, a firearm 10 (partially illustrated) incorporates a two stage trigger assembly designated generally by the numeral 12. In accordance with the invention, the two stage trigger assembly has application in connection with numerous types and makes of firearms. The partially illustrated firearm 10 is a bolt action firearm which is illustrated for purposes of describing the invention. The specific depicted firearm 10 should not be deemed a limitation of the two stage trigger assembly 12 nor its application. The two stage trigger assembly has particular applicability in connection with sporting firearms used in athletic events involving strenuous physical activity such as the biathlon.

Firearm 10 includes a receiver 20 which receives a longitudinally retractable bolt assembly 22. A bolt handle 24 projects in offset relationship to the bolt assembly for manually retracting and locking the bolt for loading and unloading the firearm in a conventional manner. The bolt assembly includes a spring loaded firing pin (not illustrated) which is released through a sear 30 (FIG. 5) by means of manual rearward actuation of a trigger 40 (FIGS. 2 and 3) in a two stage sequence described below. The underside of the receiver further includes a conventional longitudinal bolt guide slot 25.

A pair of transversely equidistantly spaced studs 26,28 integrally project downwardly from the underside of the receiver 20. The studs 26 define an intermediate slot for receiving the sear 30 and the trigger 40, as well as a searprop 50 (FIG. 4) and the various associated components. The studs 26,28 form a support structure for pivotally mounting the sear, the trigger and the searprop. A cross pin 32 is secured in an upper location of the studs to pivotally mount the sear. A second cross pin 34 is threadably secured to the studs to pivotally mount the trigger and the searprop.

Figure 3:
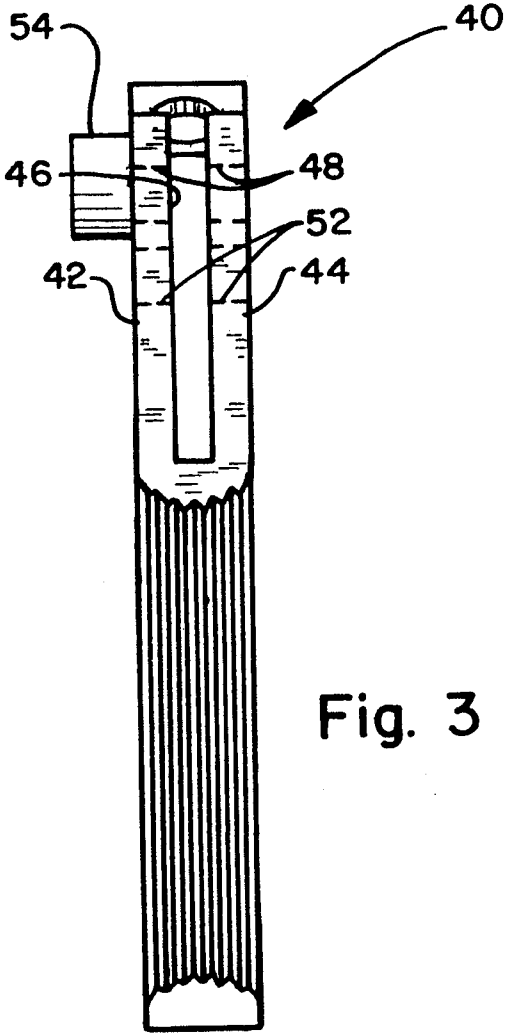
FIG. 3 is a frontal view of the trigger of FIG. 2.
Figure 2:
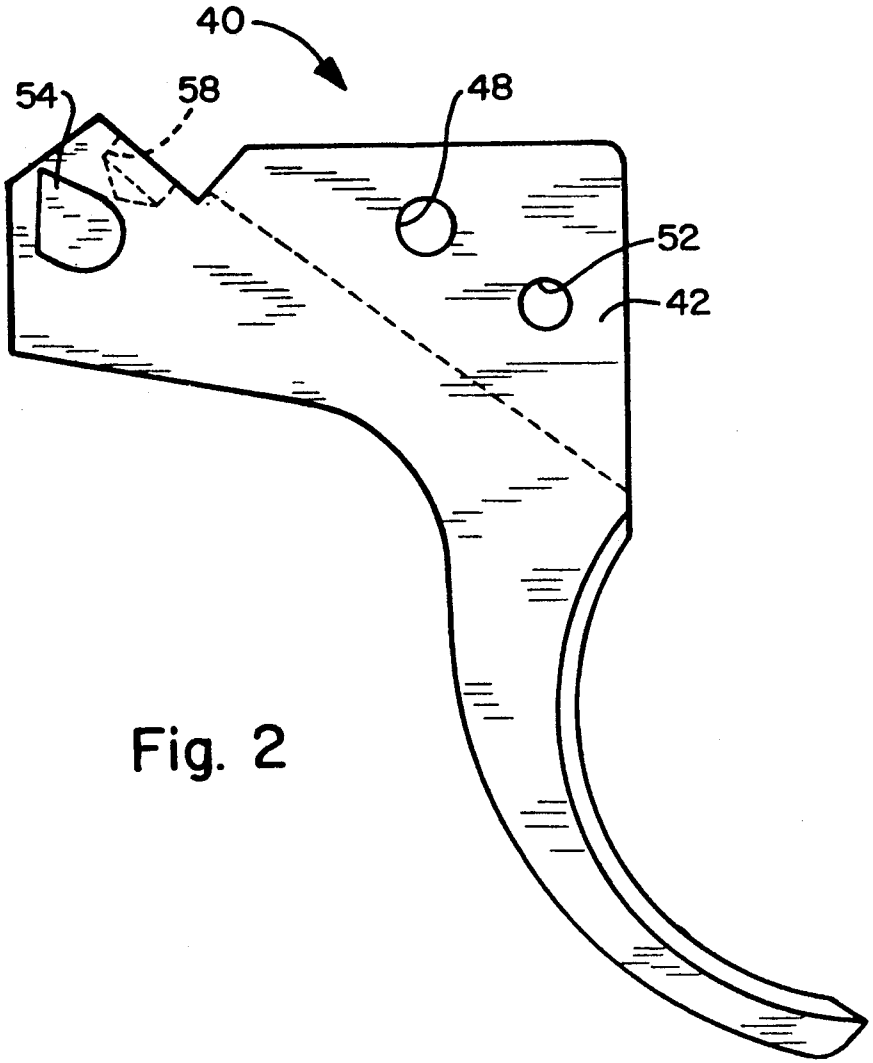
FIG. 2 is an enlarged side view, partly in phantom, of a trigger employed in the trigger assembly of FIG. 1.

With reference to FIGS. 2 and 3, the trigger 40 includes, at an upper forward location, a pair of integral, transversely spaced panels 42 and 44 which define a central slot 46 for receiving the searprop 50. The panels have two opposed pairs of openings 48 and 52. Opening 48 is dimensioned to receive the cross pin 34 for pivotally mounting the trigger to the studs. The trigger also includes a transversely projecting lug 54 which is engageable by a bi-positionable safety 55 having a catch 56. In a safety position, the catch captures the lug to prevent pivotal movement of the trigger. In a fire position, the safety arm is pivoted to permit disengagement of the catch from the lug to thereby allow trigger actuated firing of the firearm. The trigger also includes a spring bore 58 which receives a spring subassembly 62 for biasing the trigger to the forward position.

Figures 4, 5:
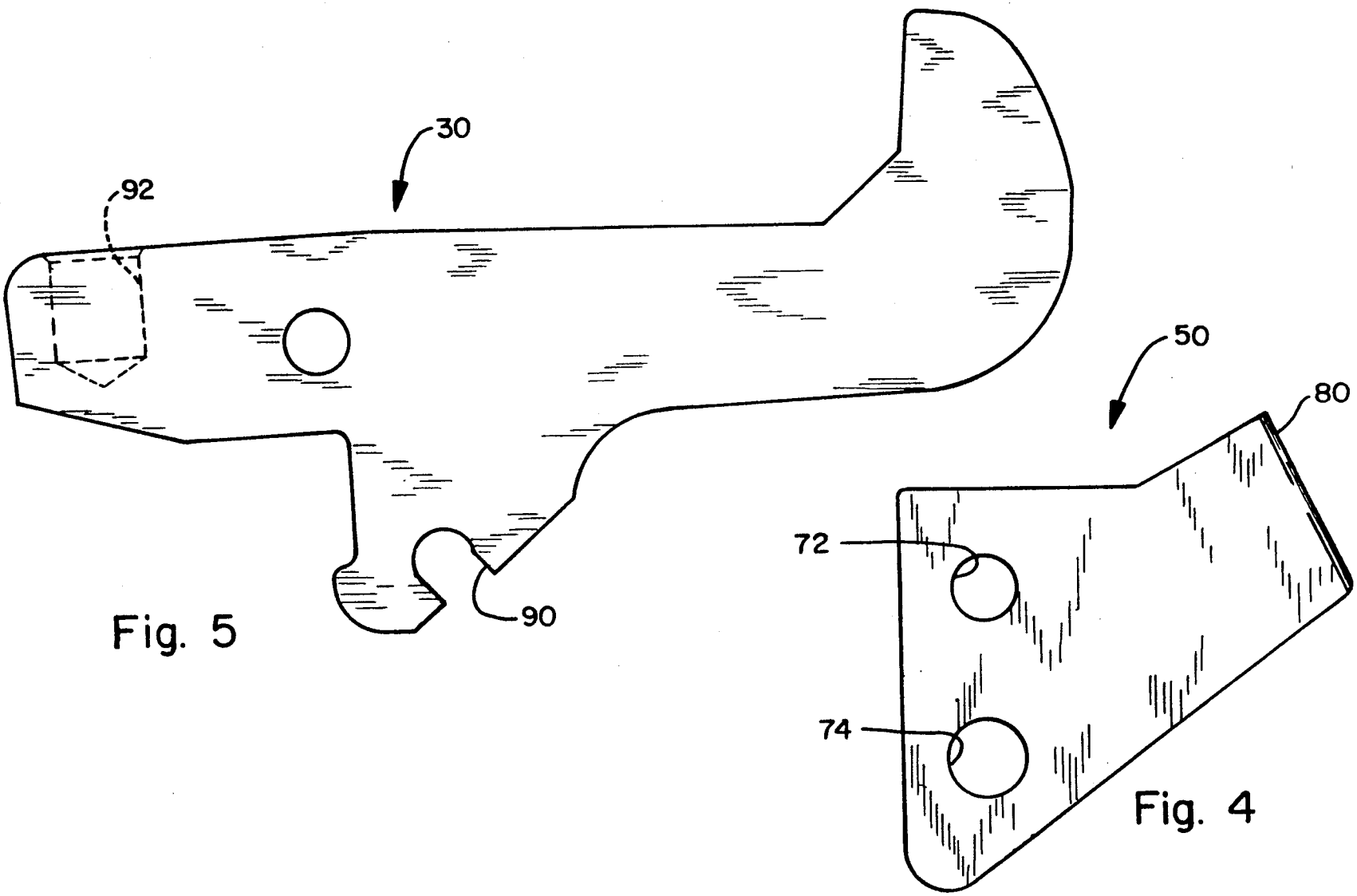
FIG. 4 is an enlarged side view of a searprop employed in the trigger assembly of FIG. 1.
FIG. 5 is an enlarged side view, partly in phantom, of a sear which is employed in the trigger assembly of FIG. 1.

With reference to FIG. 4, the searprop 50 is a plate-like member having a pair of generally aligned apertures 72 and 74. Aperture 74 is enlarged in relation to openings 48 and 52. Apertures 72 and 74 generally align with the corresponding openings 48 and 52 of the trigger. The searprop is received in the trigger slot 46 and pivotally secured to the studs 26,28 by means of the cross pin 34 which also mounts the trigger. A fixed pin 78 extends between the panels of the trigger and through the enlarged aperture 74 of the searprop. The pin 78 has a diameter which is less than the diameter of the searprop aperture 74. In one embodiment, the diameter of the pin 78 is 0.094 inches and the diameter of the searprop aperture 74 is 0.1160 inches. The distal or working end of the searprop forms a pointed shoulder 80 which engages the underside of the sear in the pre-fire or cocked position. The locations of the pin 78, the enlarged aperture 74 and the pivot axes of the trigger and the searprop are selected to provide a specific dynamic relationship between the trigger and the searprop as detailed below.

With reference to FIG. 5, the sear includes a notch 90 which is supportably engaged by the shoulder 80 of the searprop in the pre-fire cocked position. The sear also includes an opening 92 at the rear for receiving a sear spring 94 for pivotally biasing the sear in the counter-clockwise direction as depicted in FIG. 1.

In the FIG. 1 pre-fire cocked position, the searprop shoulder 80 engages the underside of the sear so that the sear is prevented from clockwise pivoting. The inter-relationships of the pin 78, the searprop 50 and the trigger 40, and in particular the inter-relationships relative to the searprop aperture 74, provide the two stage trigger actuation. In the cocked position, the pin 78 is generally positioned forwardly in the aperture toward the muzzle end of the firearm, as best illustrated in FIG. 1. The pin forces the searprop to pivot upwardly (counter-clockwise in FIG. 1) when the cocked position is assumed.

Figure 6:
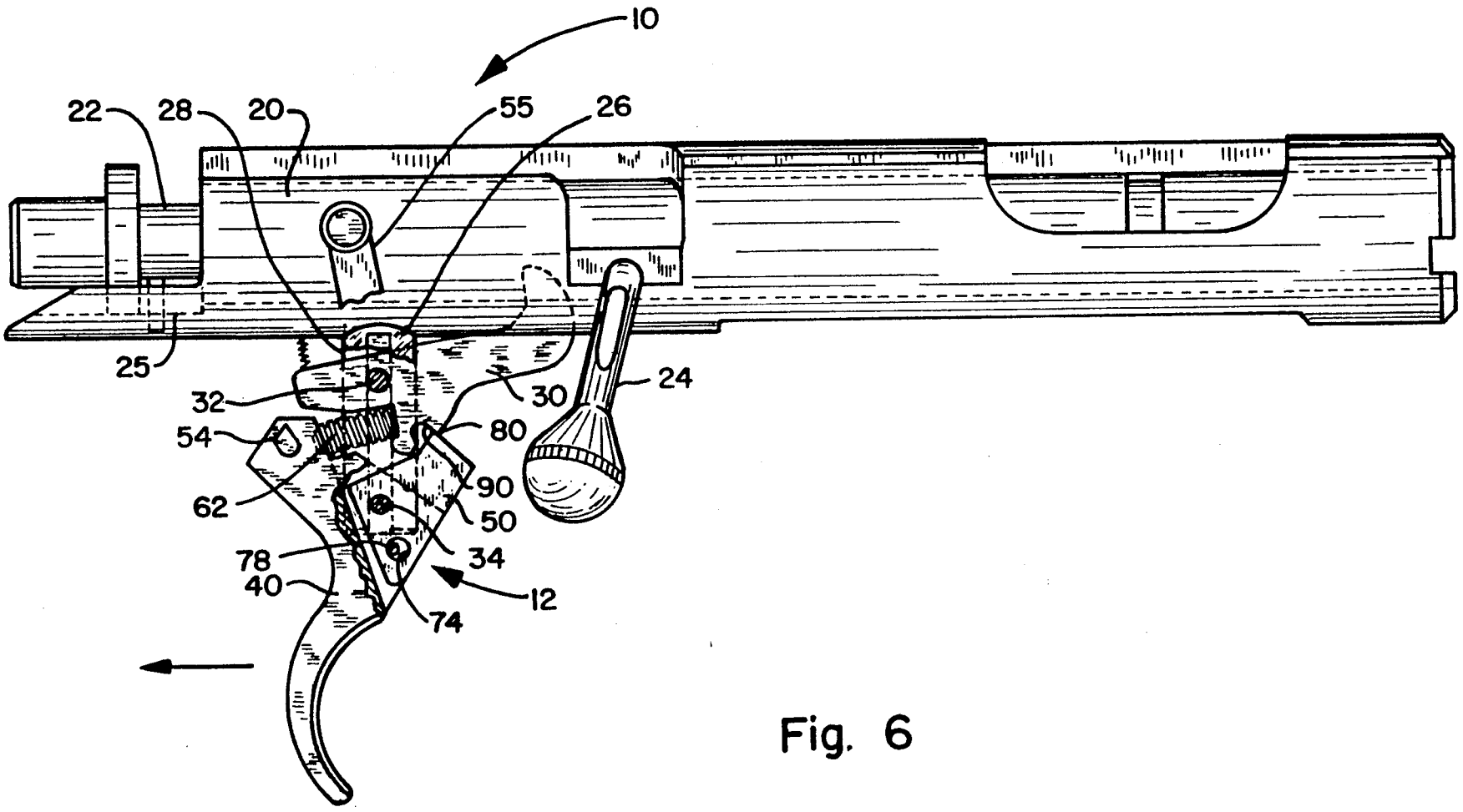
FIG. 6 is an enlarged fragmentary side view, partly broken away and partly in phantom, of the trigger assembly of FIG. 1 illustrating a first stage of the trigger actuation.
Figure 7:
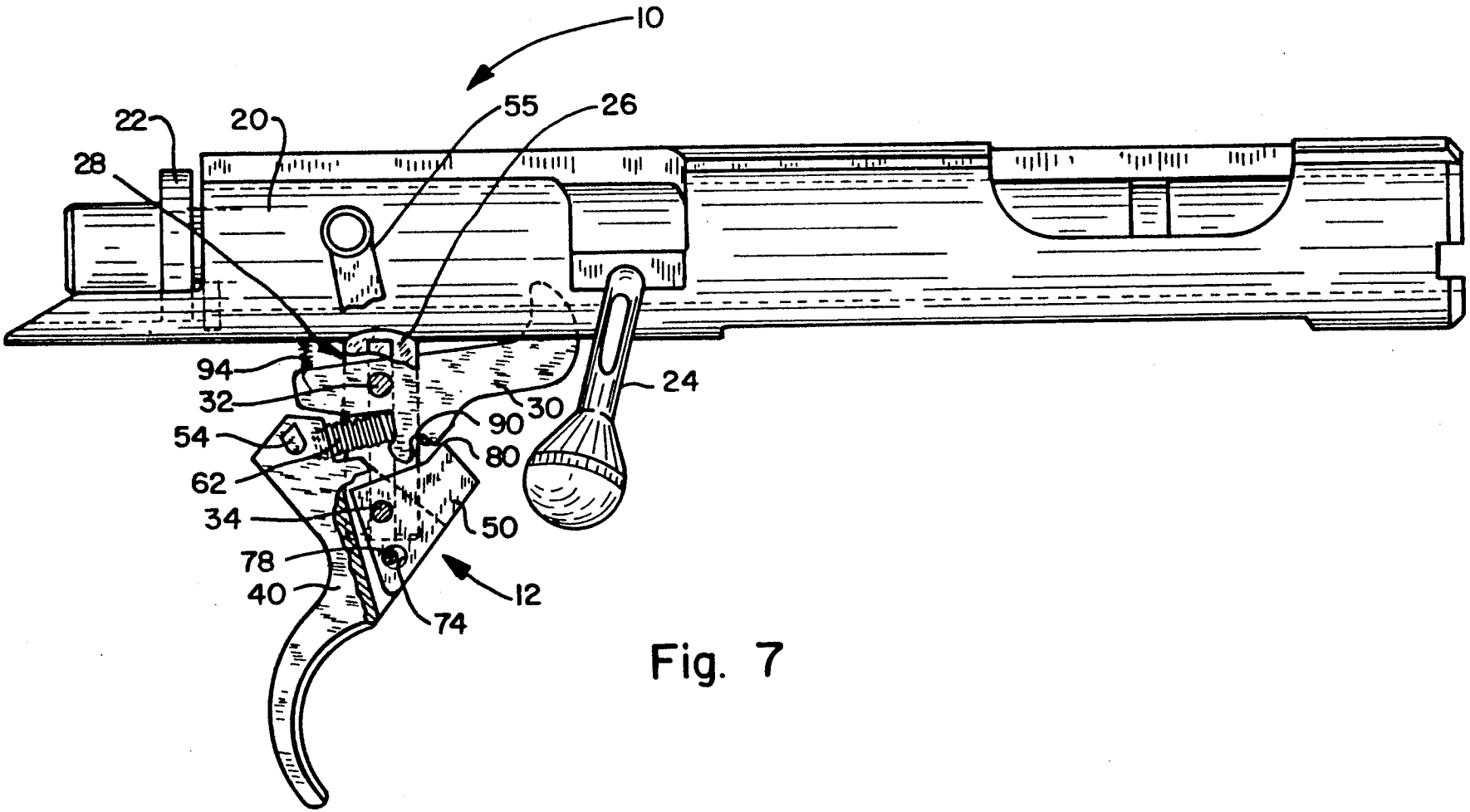
FIG. 7 is an enlarged fragmentary side view, partly broken away and partly in phantom, of the trigger assembly of FIG. 1 illustrating a second stage of the trigger actuation.

With reference to FIG. 6, as the trigger is pulled rearwardly in the direction of the arrow, the pin 78 moves generally rearwardly relative to the initially fixed searprop aperture 74 in the first stage until the FIG. 6 pin/aperture position is obtained. During the first stage, the trigger 40 is essentially pulled against the relatively small bias force of the trigger spring 62, and the trigger moves rearwardly while the searprop 50 remains stationary. At the FIG. 7 position, upon continued rearward actuation of the trigger, however, the pin 78 engages the rear wall defining portions of the searprop aperture 74 to force the searprop to pivot in a clockwise direction as the trigger continues to be pulled so that the engagement shoulder 80 moves downwardly to disengage from the sear notch 90. The sear is thus released and the sear pivots clockwise to release the firing pin and fire the firearm.

The sear 30 is biased by spring 94 and the trigger 40 is biased by spring assembly 62. Upon release of the trigger, the trigger pivots forwardly in a counter-clockwise direction so that pin 78 engages the forward wall defining portions of the aperture 74 as illustrated in FIG. 1. The trigger and searprop pivot counter-clockwise as a unit and the sear pivots counter-clockwise to allow for the re-engagement of the searprop with the sear in the pre-fire cocked position.

It will be appreciated that the foregoing trigger assembly provides an efficient means to implement a two stage trigger actuation of the firearm. The stages are essentially defined by the engagement of the pin with the rear wall of the searprop aperture. During the first stage movement of the trigger from the initial cocked position to the pin/searprop engagement position, there is essentially a lost motion coupling between the trigger and the searprop. Upon continuation of the trigger pull, during the second stage the searprop is engaged or caught by the pin so that the searprop and the trigger move synchronously to release the sear and fire the firearm.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A trigger assembly for a firearm having a receiver comprising:

trigger means comprising a pin;

mounting means for pivotally mounting said trigger means at the underside of said receiver;

spring means for biasing said trigger means to a forward pivotal position;

searprop means pivotally mounted to said mounting means and having a distal engagement means, said searprop means comprising aperture means for defining an aperture, said pin extending through said aperture and the diameter of the pin being less than the diameter of the aperture;

sear means pivotally mounted to said mounting means and engageable by said engagement means for releaseably retaining said sear means in a cocked pivotal position;

so that during a first stage as said trigger means is pulled rearwardly from the forward cocked position against the bias of said spring means to a second pivotal position, said searprop engagement means remains in a substantially fixed relationship with said sear means, and during a second stage as said trigger means continues rearwardly from said second position, said trigger means catches said searprop means wherein said pin engages said aperture means to pivot said searprop means and said engagement means disengages from said sear means to thereby release said sear means.

2. The trigger assembly of claim 1 wherein said trigger means and said searprop means each define an opening and said mounting means comprises a pin extending through each opening to pivotally mount said trigger means and said searprop means.

3. The trigger assembly of claim 1 wherein said trigger means defines a slot and said searprop means is at least partially received in said slot.

4. The trigger assembly of claim 3 wherein said searprop means defines an aperture and further comprising a pin extending through said aperture and traversing said slot and being mounted in fixed relationship to said trigger means to allow for limited relative pivoted movement between said searprop means and said trigger means.

5. The trigger assembly of claim 4 wherein the diameter of the pin is less than the diameter of the aperture.

6. The trigger assembly of claim 1 wherein said engagement means comprises a toothlike shoulder.

7. The trigger assembly of claim 1 wherein said sear means includes a notch and said engagement means engages said notch.

8. A trigger assembly for a firearm having a receiver comprising:

a trigger means comprising a pin;

mounting means for pivotally mounting said trigger means at the underside of said receiver for pivotal movement about a first axis;

spring means for biasing said trigger means to a forward pivotal position;

searprop means pivotally mounted to said mounting means for pivotal movement about said first axis and having a distal engagement means, said searprop means being selectively pivotally engageable by said trigger means, said sear prop means comprising aperture means for defining an aperture, said pin extending transversely through said aperture;

sear means pivotally mounted for pivotal movement about a second axis and engageable by said engagement means for releaseably retaining said sear means in a cocked pivotal position;

so that during a first stage as said trigger means is pulled rearwardly from the forward cocked position against the bias of said spring means to a second pivotal position, said searprop engagement means remains in a substantially fixed relationship with said sear means, and during a second stage as said trigger means continues rearwardly from said second position, said trigger means catches said searprop means wherein said pin engages said aperture means to pivot said searprop means and said engagement means disengages from said sear means to thereby release said sear means.

9. The trigger assembly of claim 8 wherein said trigger means and said searprop means each define an opening and said mounting means comprises a pin extending through each opening to pivotally mount said trigger means and said searprop means.

10. The trigger assembly of claim 8 wherein the diameter of the pin is less than the diameter of said aperture.

11. The trigger assembly of claim 8 wherein said trigger means defines a slot and said searprop means is at least partially received in said slot.

12. The trigger assembly of claim 11 wherein said searprop means defines an aperture and further comprising a pin extending through said aperture and traversing said slot and being mounted in fixed relationship to said trigger means to allow for limited relative pivoted movement between said searprop means and said trigger means.

13. The trigger assembly of claim 12 wherein the diameter of the pin is less than the diameter of the aperture.

14. A trigger assembly for a firearm having a receiver comprising:

trigger means comprising a transversely projecting pin;

mounting means for pivotally mounting said trigger means for pivotal movement about a first axis;

spring means for biasing said trigger means to a forward pivotal position;

searprop means mounted to said mounting means for pivotal movement about said first axis and having a distal engagement shoulder, said searprop means comprising aperture means for defining an aperture, said pin extending through said aperture and having a diameter less than said aperture;

sear means pivotal about a second axis and engageable by said engagement shoulder wherein said sear means is releaseably retainable in a cocked pivotal position;

so that as said trigger means is pulled rearwardly from the forward cocked position against the bias of said spring means to a second pivotal position, said pin does not engage said aperture means and said searprop means engagement shoulder remains in a substantially fixed relationship with said sear means, and as said trigger means continues rearwardly from said second position, said pin engages said aperture means to pivot said searprop means and said engagement shoulder disengages from said sear means to thereby release said sear means.

15. The trigger assembly of claim 14 wherein said trigger means and said searprop means each define an opening and said mounting means comprises a second pin extending through each opening to pivotally mount said trigger means and said searprop means.

16. The trigger assembly of claim 14 wherein said trigger means defines a slot and said searprop means is at least partially received in said slot.

17. The trigger assembly of claim 14 wherein said first axis is located between said second axis and said pin.

18. A trigger assembly for a firearm having a receiver comprising:

trigger means comprising slot means for defining a slot;

mounting means for pivotally mounting said trigger means at the underside of said receiver;

spring means for biasing said trigger means to a forward pivotal position;

searprop means pivotally mounted to said mounting means and having a distal engagement means, said searprop means being at least partially received in said slot and said trigger means catching said searprop means at a selected position; and sear means pivotally mounted to said mounting means and engageable by said engagement means for releaseably retaining said sear means in a cocked pivotal position;

so that during a first stage as said trigger means is pulled rearwardly from the forward cocked position against the bias of said spring means to a second pivotal position, said searprop engagement means remains in a substantially fixed relationship with said sear means, and during a second stage as said trigger means continues rearwardly from said second position, said trigger means catches said searprop means to pivot said searprop means and said engagement means disengages from said sear means to thereby release said sear means.

19. The trigger assembly of claim 18 wherein said trigger means and said searprop means each define an opening and said mounting means comprises a pin extending through each opening to pivotally mount said trigger means and said searprop means.

20. The trigger assembly of claim 18 wherein said engagement means comprises a tooth-like shoulder.

21. The trigger assembly of claim 18 wherein said sear means includes a notch and said engagement means engages said notch.

* * * * *